US005956950A

United States Patent [19]

Gensert et al.

[11] Patent Number: 5,956,950

[45] Date of Patent: Sep. 28, 1999

[54] ARRANGEMENT FOR ISOLATING TORSIONAL VIBRATION

[75] Inventors: Heiko Gensert, Waiblingen; Horst Schneider, Gammelshausen, both of Germany

[73] Assignee: DaimlerChrysler AG, Stuttgart, Germany

[21] Appl. No.: 08/897,413

[22] Filed: Jul. 21, 1997

[30] Foreign Application Priority Data

Jul. 26, 1996 [DE] Germany ..... 196 30 222

[51] Int. Cl.[6] ..... F01N 7/00

[52] U.S. Cl. ..... 60/322; 285/226

[58] Field of Search ..... 60/322; 285/114, 285/226, 298

[56] References Cited

U.S. PATENT DOCUMENTS

| | | | |
|---|---|---|---|
| 3,082,795 | 3/1963 | Heller | 285/226 |
| 3,318,335 | 5/1967 | Heller | 285/226 |

FOREIGN PATENT DOCUMENTS

| | | |
|---|---|---|
| 0 432 436 | 6/1991 | European Pat. Off. . |
| 432436 | 6/1991 | European Pat. Off. . |
| 0 736 679 | 10/1996 | European Pat. Off. . |
| 32 19 360 | 12/1982 | Germany . |
| 33 39 762 | 5/1985 | Germany . |
| 32 49 627 | 5/1986 | Germany . |
| 0 421 924 | 10/1992 | Germany . |
| 42 19 241 | 10/1992 | Germany . |
| 43 45 052 | 7/1995 | Germany . |

*Primary Examiner*—Thomas E. Denion
*Attorney, Agent, or Firm*—Klaus J. Bach

[57] ABSTRACT

In an arrangement for isolating torsional vibration in exhaust systems of internal combustion engines, an axially corrugated tube is provided in the exhaust pipe. The axial corrugation are distributed in spaced relationship over the circumference of the tube. The corrugated tube is resilient in a radial direction and is provided, at both ends, with connection stubs for direct connection to exhaust system pipes.

5 Claims, 1 Drawing Sheet

ARRANGEMENT FOR ISOLATING TORSIONAL VIBRATION

BACKGROUND OF THE INVENTION

The invention relates to an arrangement for isolating torsional vibrations in exhaust systems of internal combustion engines.

DE 33 39 762 A1 discloses a sound-insulating steel bellows compensator with fastening flanges made of a sound-absorbing, non-metallic material and with a reinforcement ring made of sheet steel.

Furthermore, DE 32 49 627 C2 discloses a flexible pipe element in the form of a corrugated tube which is used in exhaust systems of internal combustion engines. This pipe element is used for noise damping; however, because of its profile structure, isolation of torsional vibration is not possible.

DE 42 12 241 A1 discloses an articulated connection of tube parts which is likewise used in exhaust systems of internal combustion engines. In this case, a supporting pad which extends all around the tube parts in the form of a ring and has damping properties is intended to provide support against torsional movement. The supporting pad is the intermediary for a positively locking connection between an inner ring and an annular part in which the inner ring is supported.

The design of this connection, however is very complicated and has the disadvantage, inter alia, that the connection is not gas tight. A further disadvantage with this connection is that the support against the torsional movement depends to a large extent on the material used for the supporting pad.

It is the object of the present invention to provide an arrangement for isolating torsional vibration which is of simple design and is suitable for mass production.

SUMMARY OF THE INVENTION

In an arrangement for isolating torsional vibration in exhaust systems of internal combustion engines, an axially corrugated tube is provided in the exhaust pipe. The axial corrugation are distributed in spaced relationship over the circumference of the tube. The corrugated tube is resilient in a radial direction and is provided, at both ends, with connection stubs for direct connection to exhaust system pipes.

The axially extending corrugations distributed over the circumference provide for an arrangement which is suitable for isolating torsional vibration in exhaust systems of internal combustion engines. Since, at both ends, connection stubs are provided for direct connection to pipes of the exhaust system, the arrangement is gas tight, even without weld seams, and can be produced and installed very easily.

Advantageous embodiments of the invention are described in greater detail in the following description with reference to the accompanying drawings.

DESCRIPTION OF PREFERRED EMBODIMENTS

Figure 2:
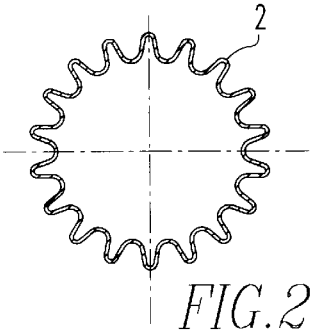
FIG. 2 is a vertical cross-sectional view taken along line II—II of FIG.1.
Figure 1:
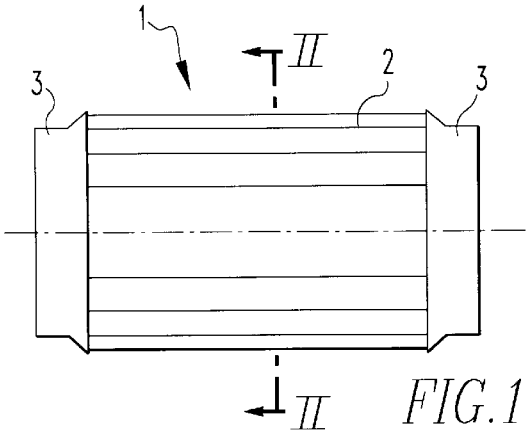
FIG. 1 is a side view of the arrangement according to the invention.

The exemplary embodiment according to FIGS. 1 and 2 illustrates a corrugated tube 1 with axially extending corrugations 2. The corrugated tube 1 is thus resilient in the radial direction and can absorb torsional movement. Both ends of the corrugated tube 1 are provided with connection stubs 3 for a direct connection to pipes (not illustrated) of an exhaust system. The characteristics of the corrugated tube 1 can be modified by the number of corrugations 2 and the sheet-metal thickness.

Figure 4:
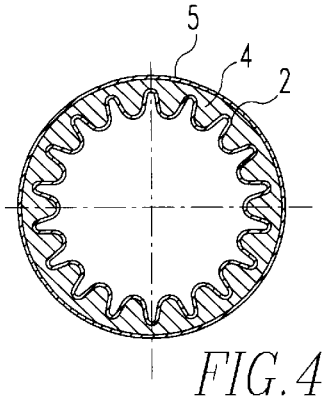
FIG. 4 is a vertical cross-sectional view taken along line IV—IV of FIG. 3.
Figure 3:
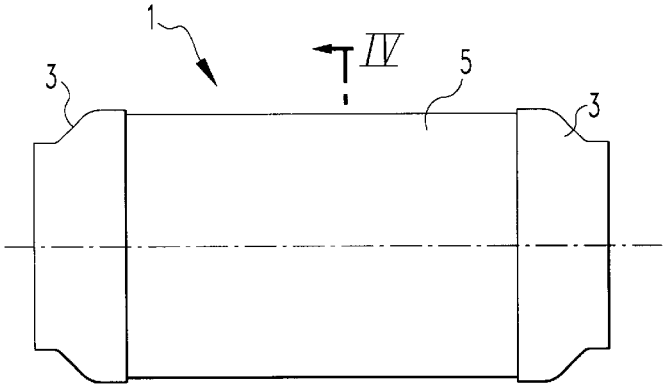
FIG. 3 is a side view of a second embodiment of the invention.

A second exemplary embodiment of the invention is illustrated in FIGS. 3 and 4. In this case, the corrugated tube 1 is enclosed by a knit wire structure 4 in such a way that the outwardly projecting corrugations are embedded in the knit wire structure 4 as shown in the cross-sectional view of FIG. 4. This achieves acoustic improvements for the corrugated tube 1. In order to prevent the knit wire structure 4 from becoming detached during operation, it is enclosed by a protective tubular sheath 5. This embodiment of the invention improves the structure-borne sound emission of the corrugated tube 1 to a considerable degree.

Figure 6:
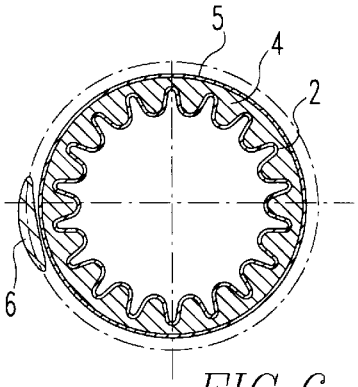
FIG. 6 is a vertical cross-sectional view taken along line VI—VI of FIG. 5.
Figure 5:
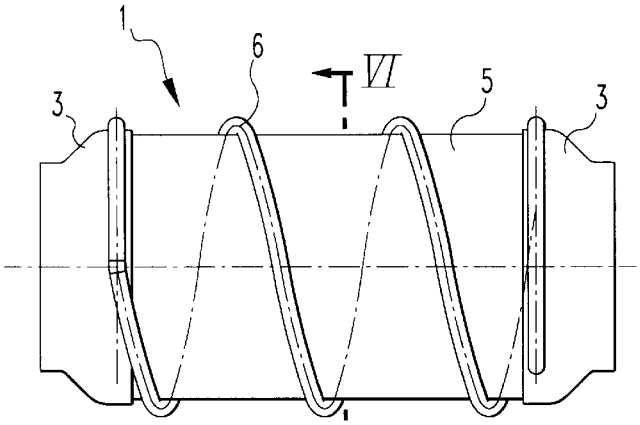
FIG. 5 is a side view of a third embodiment of the invention.

A third exemplary embodiment of the invention is shown in FIGS. 5 and 6. It is a further development of the arrangement as shown in FIGS. 3 and 4. In addition to the elements shown in the latter figures, helically extending stiffening ribs 6 are disposed over the protective sheath 5. This results in a self-supporting structure for the corrugated tube 1. Furthermore, the characteristics of the corrugated tube 1 can be influenced by the characteristics of the stiffening ribs. The helical stiffening ribs 6 may be spring-like ribs which permit movement in the radial direction and thus do not inhibit the isolation of torsional vibration. Nevertheless, they stiffen the component such that it is self-supporting.

What is claimed is:

1. An arrangement for isolating torsional vibration in exhaust systems of internal combustion engines comprising a corrugated tube having axially extending corrugations arranged in circumferentially spaced relationship said corrugated tube being compliant in the radial direction and being provided, at both ends, with connection stubs for direct connection to pipes of an exhaust system, said corrugated tube being surrounded by a knit wire structure extending into the recesses formed by the axial corrugations such that said corrugated tube is embedded in said knit wire structure, and said knit wire structure being encased by a protective sheath firmly engaging said knit wire structure with said corrugated tube to hold said knit wire structure in said recesses in firm engagement with said corrugated tube.

2. An arrangement according to claim 1, wherein said protective sheath is a knit wire tube.

3. An arrangement according to claim 1, wherein said protective sheath is provided on its outer circumference with stiffening ribs.

4. An arrangement according to claim 3, wherein said stiffening ribs extend helicly in a longitudinal direction over the circumference of said protective sheath.

5. An arrangement according to claim 4, wherein the stiffening ribs are formed by a helical spring.

* * * * *